United States Patent [19]

Yoneda et al.

[11] Patent Number: 5,025,544

[45] Date of Patent: Jun. 25, 1991

[54] METHOD OF JOINING SLIDER BODY AND PULL TAB

[75] Inventors: Masataka Yoneda, Kurobe; Shunichi Nakamura, Toyama, both of Japan

[73] Assignee: Yoshida Kogyo K. K., Tokyo, Japan

[21] Appl. No.: 559,208

[22] Filed: Jul. 30, 1990

[30] Foreign Application Priority Data

Aug. 11, 1989 [JP] Japan ..... 1-208912

[51] Int. Cl.[5] ..... B21D 53/54

[52] U.S. Cl. ..... 29/409; 29/766

[58] Field of Search ..... 29/408, 409, 766, 33.2

[56] References Cited

U.S. PATENT DOCUMENTS

| | | | |
|---|---|---|---|
| 2,299,133 | 10/1942 | Epes | 29/409 |
| 2,354,690 | 8/1944 | Lawson | 29/409 |
| 2,693,217 | 11/1954 | Lange | 29/766 |
| 2,825,126 | 3/1958 | Legat et al. | 29/409 |
| 3,234,635 | 2/1966 | Jakob | 29/409 |

*Primary Examiner*—P. W. Echols

*Attorney, Agent, or Firm*—Hill, Van Santen, Steadman & Simpson

[57] ABSTRACT

A series of pull tabs are continuously fed to one end of a horizontal transport path; a series of slider bodies are continuously fed to the other end of the horizontal transport path; a lowermost slider body is placed into horizontal posture and into opposed relation to a lowermost pull tab on the horizontal transport path; the lowermost slider body and the lowermost pull tab are moved towards each other to thus bring the attachment lug of the former and the attachment portion of the latter into registry with each other; and then the attachment lug of the slider body and the attachment portion of the pull tab are joined. Burs on the slider body are removed by a trimming jaw while the slider body and its pull tab move toward each other.

4 Claims, 5 Drawing Sheets

METHOD OF JOINING SLIDER BODY AND PULL TAB

BACKGROUND OF THE INVENTION

1. Field of the Invention

The present invention generally relates to a method of assembling sliders and particularly a method of joining a slider body and a pull tab diecasted separately from each other.

2. Description of the Prior Art

Japanese Patent Publication No. 1-25563 discloses a conventional slider-assembling apparatus of the type described above. The conventional apparatus comprises a pair of juxtaposed slant chutes, the first chute for feeding a series of slider bodies from a slider body hopper to one end of a horizontal transport path and the second chute for feeding a series of pull tabs from a pull tab hopper to a position above the transport path a little ahead of the path end. The leading slider body rests flat on the transport path with its attachment lug opened forwards, while the leading pull tab hangs at the end of the second chute via its own weight with its attachment aperture directed downwards ready to be caught by the opened lug of the slider body. The leading slider body is pushed forwards by a pusher horizontally along the transport path, thus causing the distal end of the attachment lug on the slider body to catch the aperture of the leading pull tab hanging from above. The slider body continues to advance until it stops at a slider-assembling station, where, an anvil member advances along the transport path from its opposite end, to intrude into the slider body. At this instant, a presser rod descends to press down the distal end of the attachment lug to thereby confine the aperture of the pull tab to the attachment lug, so that the pull tab is pivotally joined to the attachment lug on the slider body. Thereafter, the anvil member retracts from the assembling station while holding the assembled slider thereon and then discharges the assembled slider through a withdrawal exit of the apparatus.

Although this conventional assembling apparatus proves to be satisfactory to some extent, it suffers from several disadvantages. Since a pull tab is merely hanging before the slider assembling station, the pull tab is prone to be laterally displaced from the path of the attachment lug of the slider body. If the slider body is pushed forwards by the pusher in this disposition, the attachment lug fails to catch the aperture of the pull tab, and the pull tab can not be joined to the slider body.

Since the aperture in the pull tab varies in shape, size and position; the attachment lug must be spread apart from the upper surface of the slider body as widely as possible in order to assuredly catch the various apertures of the hanging pull tab. Since the attachment lug is spread apart so widely, closing the attachment lug for joining the pull tab to the slider body causes the lug to be subjected to severe deformation, so the attachment lug is more likely to break or be damaged.

Furthermore, there are problems that two slider bodies are inclined to be erroneously transported at the same time by a pusher and that the front end of the pusher is apt to be jammed into the preceding horizontal slider body and the ensuing inclined slider body. These problems result in the apparatus becoming inoperative. Consequently, smooth transportation of the slider body from the chute to the slider-assembling station cannot be accomplished.

SUMMARY OF THE INVENTION

With the foregoing difficulties in view, it is therefore an object of the present invention to provide a method of and an apparatus for joining a slider body and a pull tab wherein assembling operation of sliders can be carried out very reliably and efficiently.

According to the first aspect of the present invention, there is provided a method of joining a slider body having an attachment lug on the upper surface thereof and a pull tab having an attachment portion, the method comprising the steps of: continuously feeding a series of pull tabs to one end of a horizontal transport path; continuously feeding a series of slider bodies to the other end of the horizontal transport path; placing a lowermost slider body and lowermost pull tab into horizontal posture and into opposed relation to each other on the horizontal transport path; moving the lowermost slider body and the lowermost pull tab towards each other to thus bring the attachment lug of the former and the attachment portion of the latter into registry with each other; and joining the attachment lug of the slider body and the attachment portion of the pull tab.

According to the second aspect of the present invention, there is provided an apparatus for joining a slider body having an attachment lug on the upper surface thereof and a pull tab having an attachment portion, the apparatus comprising: a first chute for continuously feeding a series of slider bodies; a first horizontal guide channel communicating with the first chute for receiving the lowermost slider body in horizontal posture; a second chute disposed in opposed relation to the first chute for continuously feeding a series of pull tabs; a pull tab carrier disposed beneath the lower end of the second chute for receiving the lowermost pull tab in a horizontal posture and moving the lowermost pull tab towards and away from the lowermost slider body to bring the attachment lug of the slider body and the attachment portion of the pull tab into registry with each other; and means for joining the attachment lug of the slider body and the attachment portion of the pull tab at a slider-assembling station.

Many other advantages and features of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 2:
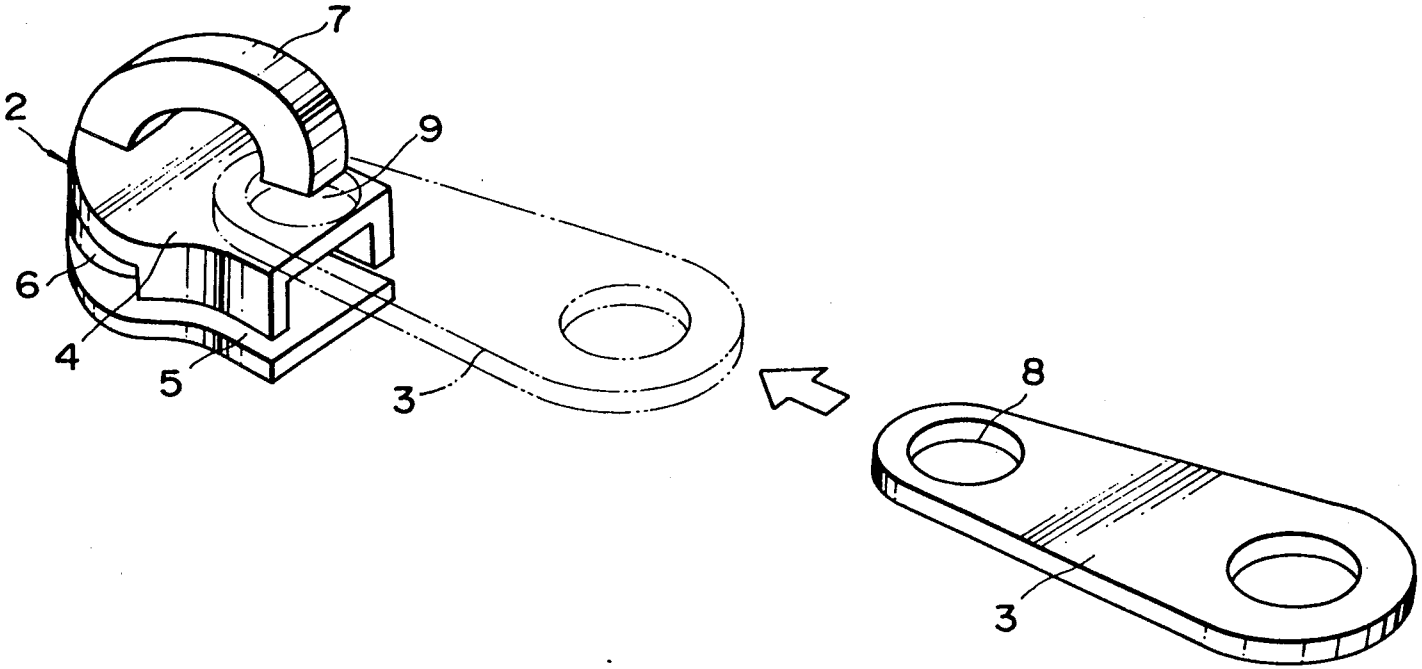
FIG. 2 is a perspective view of a slider body and a pull tab to be joined with the apparatus of FIG. 1.

As best shown in FIG. 2, through a method and with an apparatus according to the present invention, a slider body 2 and a pull tab 3 are joined together to thus provide a slide fastener slider 1. The slider body 2 comprises a pair of upper and lower wings 4, 5 integrally joined together at their respective front ends by a diamond or a neck portion 6. The upper wing 4 has on its upper surface an arcuate attachment lug 7. The arcuate attachment lug 7 has its one end secured to the front end of the upper wing 4 and has its other end spaced from the upper surface of the upper wing 4 to thus define therewith a gap 9 which is slightly greater than the thickness of the pull tab 3. The pull tab 3 is in the shape of a flat plate and has in its one end an aperture 8 through which to insert the attachment lug 7 for pivotal attachment of the pull tab 3 to the slider body 2.

Figure 1:
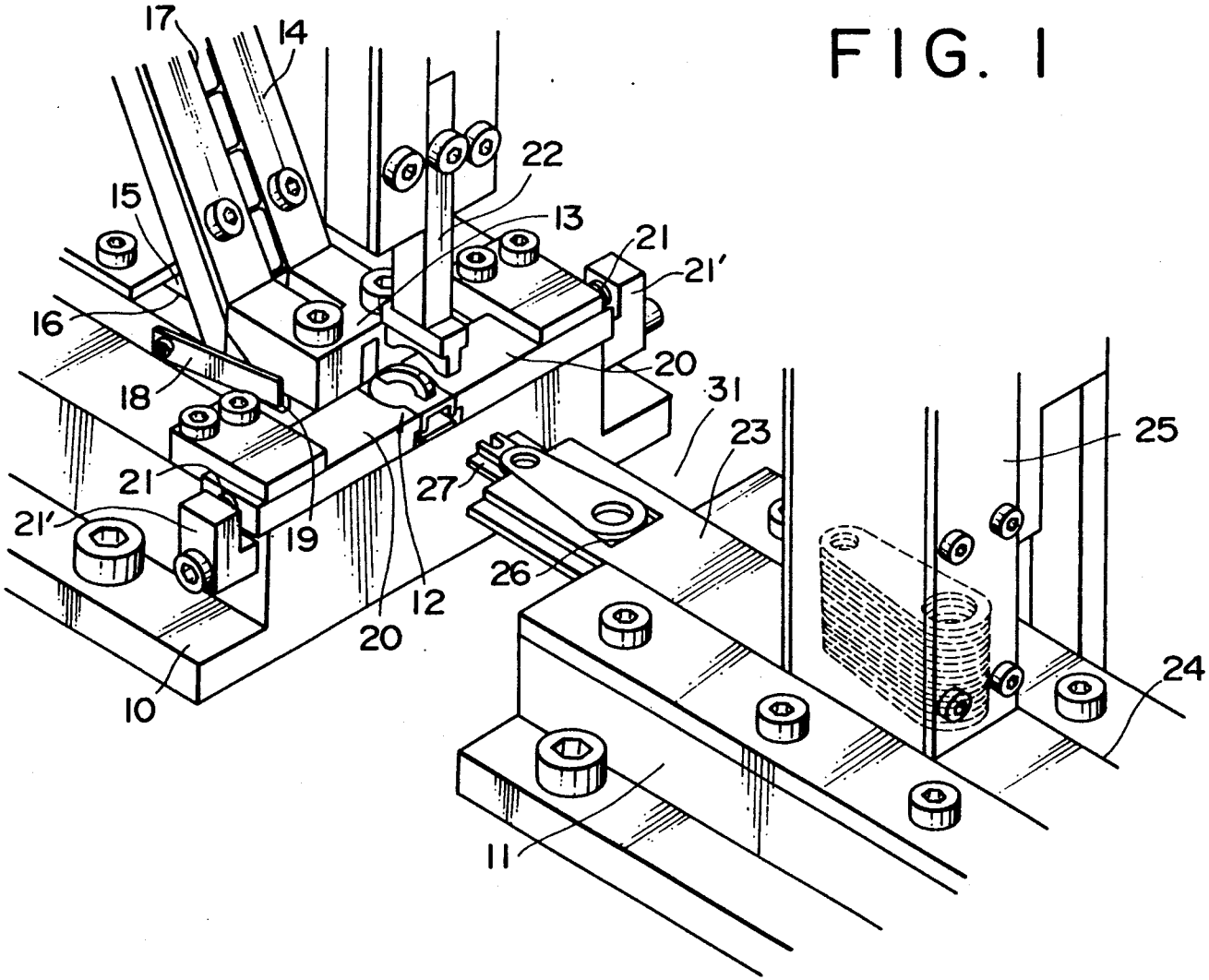
FIG. 1 is a fragmentary perspective view of an apparatus for joining a slider body and a pull tab according to the present invention.

An apparatus according to the present invention broadly comprises a pair of first and second bases 10, 11 arranged in opposed relation to each other with a predetermined distance disposed therebetween. A slider-assembling station 12 is provided on the end of the first base 10 which faces the second base 11. A guide member 13 is disposed on the first base 10 behind the slider-assembling station 12. A first slant chute 14 is disposed behind the guide member 13. A first guide channel 16 is provided longitudinal to the first base 10 and beneath the guide member 13. The guide member 13 functions to guide slider bodies 2 when they slide down from the first slant chute 14 to the horizontal guide channel 16. A pusher 15 reciprocates guidedly along the first guide channel 16 towards and away from the slider-assembling station 12. The pusher 15 has at its front end a stepped portion 15′ which is slightly longer than the distance between the slider-assembling station 12 and the lower end of the slanting first chute 14. The pusher 15 may be driven by a piston cylinder or a cam (not shown). The first chute 14 has an elongated guide groove 17 formed in the upper surface thereof and is adapted to feed the slider bodies 2 with their attachment lugs fitted through the guide groove 17. The first chute 14 extends at an angle downwards from a vibrating hopper (not shown). A pair of stoppers 19, 19 are provided one on each side of the first guide channel 16. A pair of plate springs 18, 18 (only one of which shown for brevity) are also secured one on each side of the first guide channel 16 and normally urge the stoppers 19, 19 towards each other. A pair of elongated holder plates 20, 20 are disposed normal to the first base 10 and provided one on each side of the slider assembling station 12 for reciprocation towards and away from each other. The opposed mating holder plates 20, 20 have their respective opposed ends so profiled as to snugly fit the outline of the slider body 2. A pair of spring holders 21′, 21′ are secured one to each side of the first base 10. One compression spring 21 is provided on each respective spring holder 21′ to act between the spring holder 21′ and the other end of the holder plates 20 so as to normally urge the opposed holder plates 20, 20 toward each other, so that, when pushed forward by the pusher 15, the slider body 2 is temporarily retained by and between the holding plates 20, 20 at the slider-assembling station 12. As shown in FIG. 1, over the slider-assembling station 12, there is provided a punch 22 which is adapted to vertically reciprocate toward and away from the slider-assembling station 12 to press the attachment lug 7 of the slider body 2 down so as to cause the distal end thereof to fit into the aperture 8 of the pull tab 3.

A second guide channel 24 is formed longitudinally in the second base 11 and is disposed in alignment with the first guide channel 16. Along the second guide channel 24 a pull tab carrier 23 is mounted in such a way as to slidably reciprocate towards and away from the slider-assembling station 12 on the first base 10. The pull tab carrier 23 is driven by a piston cylinder, a cam means or a like driving means (not shown), as is the case with the pusher 15. The second guide channel 24 coacts with the first guide channel 16 to jointly constitute a horizontal transport path along which the slider body 2 and the pull tab 3 move towards each other for joining thereof. There stands an upstanding second chute 25 above the second guide channel 24 in such a manner that the pull tab carrier slidably reciprocates along the lower edge of the upstanding second chute 25. A series of pull tabs 3 are piled up within the second chute 25. With such construction, pull tabs 3 are fed onto the pull tab carrier 23 one by one via their own weight. Instead of the upstanding chute 25, a slant chute may be employed.

The front end of the pull tab carrier 23 is recessed in its upper surface so as to provide a pull tab bed 26. The pull tab bed 26 conforms to the contour of the majority of a pull tab 3, so that the pull tab 3 is almost received in the pull tab bed 26 with the aperture 8 projecting beyond the front edge of the pull tab bed 26, as better shown in FIG. 1. A trimming jaw 27 is provided integrally on the front end surface of the pull tab carrier 23 so as to project towards the slider-assembling station 12. The trimming jaw 27 is adapted to intrude into the interior of the slider body 2 in order to remove burs therefrom.

Turning now to the operation of the apparatus according to the present invention. FIG. 3 (E) shows that the slider 1 has been assembled and discharged through the withdrawal exit 31 defined between the first and second base 10, 11 and, at the same time, the apparatus is ready for the next cycle of assembling a slider. In this step, the pusher 15 and the pull tab carrier 23 assume their respective retracted positions. The lower most slider 2*a* rests in horizontal posture on the first guide channel 16 and is temporarily retained by and between the opposed stoppers 19, 19 under the bias of the respective plate springs 18, 18. The second lowermost slider 2*b* still partly lies within the first chute 14 but has its front edge touching the bottom of the first guide channel 16. At this position, the second lowermost slider 2*b* remains inclined at the same angle as it was inclined while sliding down the first chute 14. At this step, the pull tab carrier 23 receives the lowermost pull tab 3 from the upstanding second chute 25.

Figure 3A:
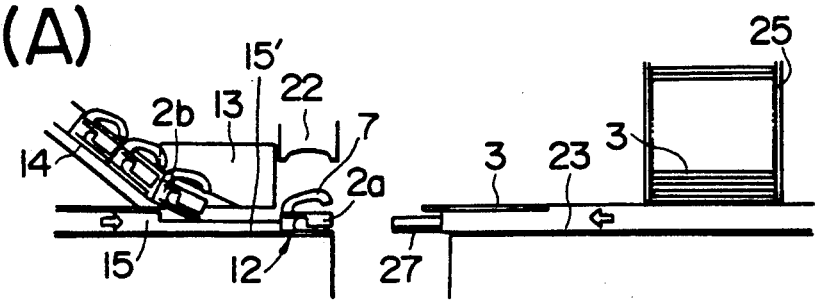
FIGS. 3(A) through 3(E) are fragmentary cross-sectional views of the apparatus of FIG. 1, showing the sequential steps of joining the slider body and the pull tab.
Figure 3B:
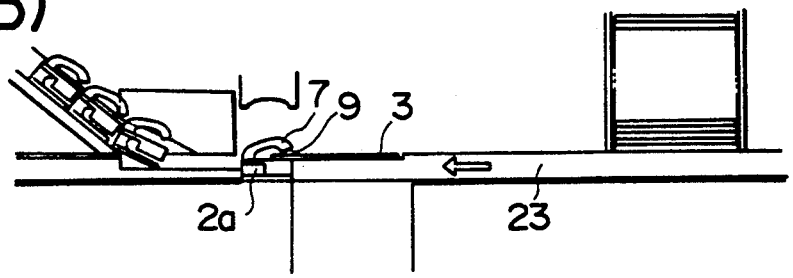

As shown in FIG. 3(A), then, both the pusher 15 and the pull tab carrier 23 are activated to advance towards the slider-assembling station 12. The advancing pusher 15 first causes the second lowermost slider 2*b* to ride on the upper surface of the stepped portion 15′ thereof so that the slider 2*b* is angularly moved to thus slacken the angle of inclination. Continued advance of the pusher 15 then causes the lowermost slider 2*a* to be transported to the slider-assembling station 12, at which the slider 2*a* is retained by and between the opposed holder plates 20, 20 under the bias of the compression springs 21, 21. Concurrently, the pull tab carrier 23 having one pull tab 3 to rest in its pull tab bed 26 advances toward the slider-assembling station 12 from the opposite side, until the trimming jaw 27 provided on the front end of the pull tab carrier 23 intrudes into the interior of the slider body 2 to remove burs from the slider body 2, as shown in FIG. 3(B). At this same instant, the aperture 8 formed in the front end of the pull tab 3 comes into registry with the gap 9 beneath the distal end of the attachment lug 7 on the slider body 2.

Figure 3C:
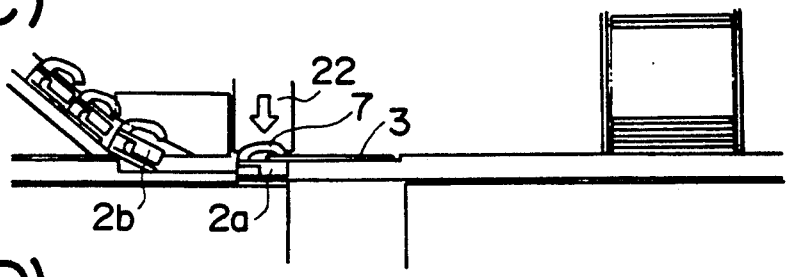

Then, as shown in FIG. 3(C), the punch 22 descends to press down the attachment lug 7 to cause the distal end thereof to fit into the aperture 8 in the pull tab 3, so that the pull tab 3 is pivotally joined to the slider body 2.

After the assembling operation is completed, the punch 22 ascends and the pusher 15 and the pull tab carrier 23 start to retract into their respective original positions. Since the trimming jaw 27 of the pull tab carrier 23 has been forcibly intruded into the rough interior surface of the slider body 2; as the pull tab carrier 23 retracts from the slider-assembling station 12, the slider body 2 accompanies the pull tab carrier 23 due to frictional resistance between the interior of the slider body 2 and the trimming jaw 27 while spreading the opposed holder plates 20, 20 apart from each other against their own resiliency. Continued retraction of the pull tab carrier 23 causes the lower wing 5 of the slider 1 to impinge on the front edge 11*a* of the second base 11 so that the trimming jaw 27 is pulled off the slider body 2 of the assembled slider 1. The assembled slider 1 thus detached from the trimming jaw 27 falls down through the withdrawal exit 31.

Figure 3D:
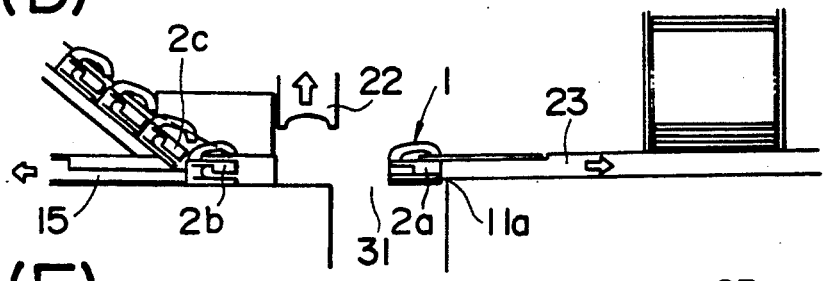

As shown in FIG. 3(D), the retraction of the pusher 15 causes the second lowermost slider body 2*b* in slackened inclination as shown in FIG. 3(C), to drop from the stepped portion 15′ thereof to the first guide channel 16 and to move angularly into a horizontal posture. Simultaneously, an ensuing slider body 2*c* slides down the first chute 14 into the guide member 13 via its own weight, thereby pushing the preceding slider body 2*b* slightly forwards into a stand-by position in which the preceding slider body 2*b* is temporarily retained by and between the opposed stoppers 19, 19 under the bias of the plate springs 18, 18. The apparatus is thus restored to the original position, as shown in FIG. 3(E).

Figure 4:
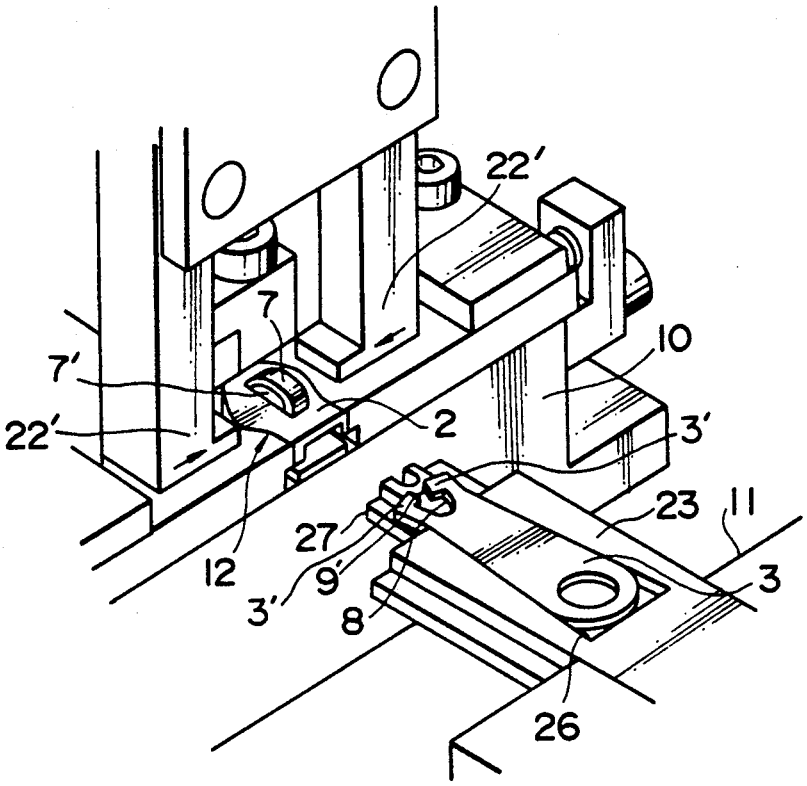
FIG. 4 is a perspective view of a slider-assembling station and the adjacent elements of an apparatus according to another embodiment of the present invention.
Figure 5:
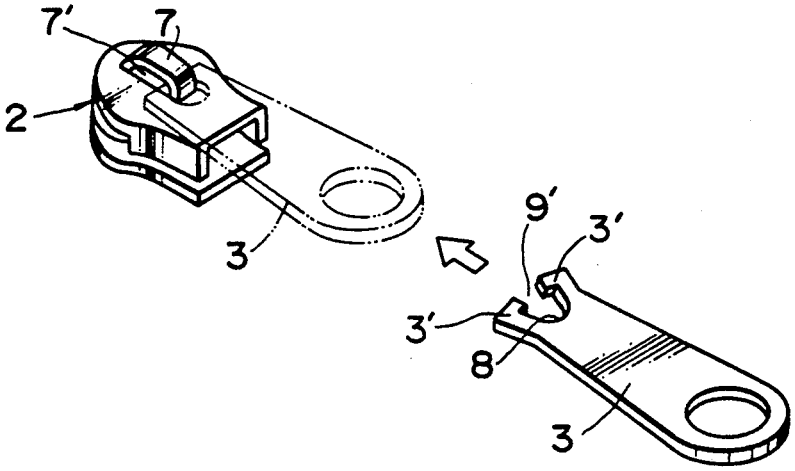
FIG. 5 is a perspective view of a slider body and a pull tab to be joined with the apparatus of FIG. 4.

In the preceding embodiment, as best shown in FIG. 2, the attachment lug 7 has beneath its distal end the gap 9 through which the aperture 8 of the pull tab 3 can be joined to the attachment lug 7. Alternatively, as shown in FIG. 5, the attachment lug 7 may have no such gap, but the attachment lug 7 may have their opposite ends joined to the upper surface of the slider body 2 to define an opening 7′ with the upper surface. And, the pull tab 3 may have at its front end a pair of bifurcations or 3′, 3′ which are spaced from each other by a gap 9′ slightly greater than the width of the attachment lug 7. In this embodiment, instead of a vertically reciprocative punch 22, a pair of clamping jaws 22′, 22′ are pivotally mounted over the slider-assembling station 12 so as to move their respective lower ends towards and away from each other. As suggested in FIG. 4, when the opposed arms 3′ 3′ come into registry with the opening 7′ of the attachment lug 7, the clamping jaws 22′, 22′ are activated to compress the opposed arms 3′, 3′ towards each other, to thus bend the arms 3′, 3′ into pivotal engagement with the opening 7′ of the attachment lug 7.

Figure 6:
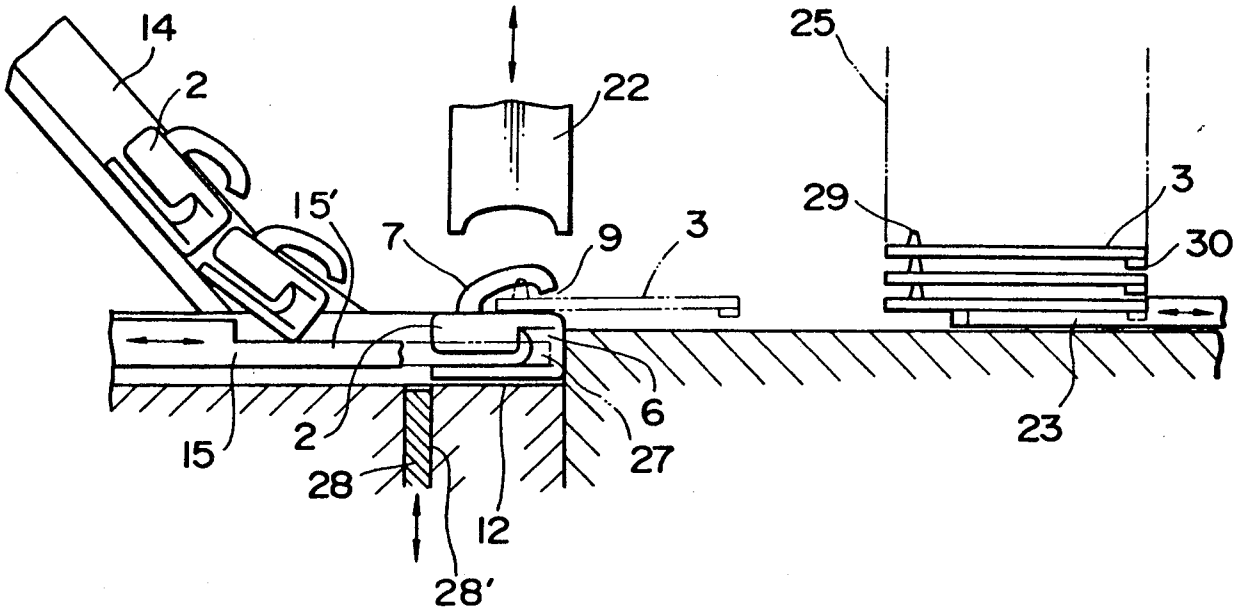
FIG. 6 is a fragmentary cross-sectional view of an apparatus according to still another embodiment of the present invention.

Furthermore, in the first embodiment, a trimming jaw 27 is provided on the front end of the pull tab carrier 23. Instead, as shown in FIG. 6, the stepped portion 15′ of the pusher 15 may function as a trimming jaw. In this event, slider bodies 2 must be fed with their rear ends devoid of diamonds 6 directed to the pusher 15 so that the diamond 6 will not interfere with the stepped portion 15′. This embodiment is advantageous in assembling a locking type slider 1 having a pull tab 3 with a locking prong 29 provided on its lower surface as shown in FIG. 6. This is because, if this pull tab 3 were applied to the preceding embodiment as shown in FIG. 1, the pull tab 3 would rest on the pull tab bed 26 with its pronged surface directed downwards, so that the prong 29 would impinge on the upper wing 4 of the slider body 2. As shown in FIG. 6, the pull tab 3 is provided at its other surface at its opposite end with a protuberance 30, which first serves to cancel out with the height of the prong 29 so as to hold the pull tabs horizontally when they are piled up along the second chute 25, and secondly, serves to facilitate manipulation of the pull tab 3 by fingers in the use of the finished slider 1. In order to hold back the slider body 2 when the stepped portion 15′ of the slider 15 retracts from the interior of the slider body 2, a stopper rod 28 is fitted in the vertical groove 28′ formed beneath and normal to the first guide channel 16 so as to reciprocate vertically therealong into and out of the first guide channel 16.

Figure 3E:
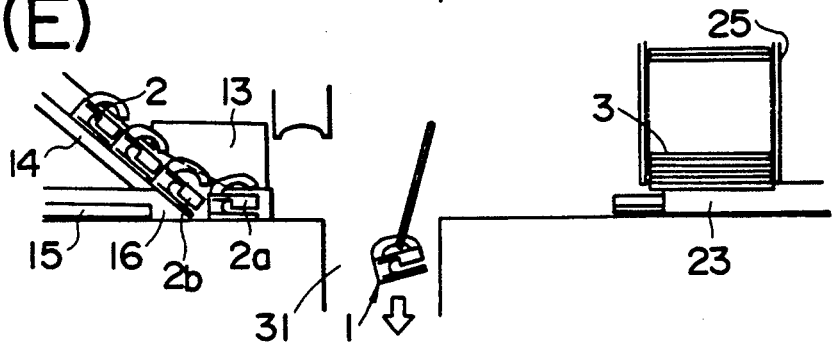

In the first embodiment, as shown in FIG. 3(A), the preceding slider body 2*a* is pushed forwards from the position shown in FIG. 3(E) all the way to the slider-assembling station 12 by the pusher 15. Alternatively, the preceding slider body 2*a* may remain in the stand-by position shown in FIG. 3(E). In this event, the pull tab carrier 23 advances beyond the slider-assembling station 12 to the stand-by position of the slider body 2*a* so as to cause the trimming jaw 27 to intrude into the interior of the slider body 2*a* to remove burs therein. Thereafter, the pull tab carrier 23 retracts to the slider-assembling station 12 with its trimming jaw 27 carrying the slider body 2*a*, at which station the punching operation is effected.

Through the method and with the apparatus according to the present invention as set forth hereinabove, it is assured that the slider body and the pull tab can be joined to each other very easily and reliably.

Since the slider body is slackened in its angle of inclination between the inclined posture which it assumes when sliding down along the first chute and the horizontal posture which it assumes when lying in the first guide channel, the angular movement of the slider body is smoothly effected, so that there are no problems that will result in the apparatus becoming inoperative such as two slider bodies being erroneously transported at one time or the front end of the pusher being jammed into between the preceding horizontal slider body and the ensuing inclined slider body, as has been encountered by prior art. Therefore, the transportation of the slider body from the hopper to the slider-assembling station can be effected reliably and smoothly.

Furthermore, burring of the slider body and assembling of the slider are effected concurrently, so that the efficiency of manufacturing the slider is enhanced many fold.

Obviously, various modifications and variations of the present invention are possible in the light of the above teaching. It is therefore to be understood that within the scope of the appended claims the invention may be practiced otherwise than as specifically described.

What is claimed is:

1. A method of joining a slider body having an attachment lug on an upper surface thereof and a pull tab having an attachment portion, the method comprising the steps of:

(a) continuously feeding a series of pull tabs on one end of a horizontal transport path;

(b) continuously feeding a series of slider bodies to another end of the horizontal transport path;

(c) placing a lowermost slider body and a lowermost pull tab into horizontal posture and into opposed relation to each other on the horizontal transport path;

(d) moving the lowermost slider body and the lowermost pull tab towards each other to thus bring the attachment lug of the former and the attachment portion of the latter into registry with each other, the slider body being burred during the moving step (d); and (e) joining the attachment lug of the slider body and the attachment portion of the pull tab.

2. A method according to claim 1, the attachment lug having a first end secured to the upper surface of the slider body and a second end spaced from the upper surface of the slider body to thus define therewith a gap which is slightly greater than a thickness of the pull tab, the attachment portion being an aperture formed in a front end of the pull tab, the joining step (e) comprising the step of pressing the attachment lug down to thus cause the second end thereof to fit into the aperture.

3. A method according to claim 1, the attachment lug having opposite ends joined to the upper surface of the slider body to define an opening with the upper surface, the attachment portion being a pair of arms provided on a front end of the pull tab and spaced from each other by a distance slightly greater than a width of the attachment lug, the joining step (e) comprising the step of compressing the arms sideways to cause the arms thereof to fit into the opening.

4. A method according to claim 1, the feeding step (b) being effected along an inclined feeding path and the method further including a step of slackening an angle of inclination of the slider body immediately before the slider body assumes horizontal posture.

* * * * *